United States Patent [19]

Niggemann

[11] Patent Number: 4,936,380

[45] Date of Patent: Jun. 26, 1990

[54] IMPINGEMENT PLATE TYPE HEAT EXCHANGER

[75] Inventor: Richard E. Niggemann, Rockford, Ill.

[73] Assignee: Sundstrand Corporation, Rockford, Ill.

[21] Appl. No.: 293,130

[22] Filed: Jan. 3, 1989

[51] Int. Cl.[5] ..... F28F 3/00

[52] U.S. Cl. ..... 165/167; 165/908

[58] Field of Search ..... 165/167, 908

[56] References Cited

U.S. PATENT DOCUMENTS

| | | | |
|---|---|---|---|
| 3,534,813 | 10/1970 | Fleming | 165/164 |
| 4,096,910 | 6/1978 | Coffinberry et al. | 165/81 |
| 4,108,242 | 8/1978 | Searight et al. | 165/164 |
| 4,347,897 | 9/1982 | Sumitomo et al. | 165/167 |
| 4,494,171 | 1/1985 | Bland et al. | 361/386 |
| 4,624,305 | 11/1986 | Rojey | 165/165 |

*Primary Examiner*—Robert G. Nilson

*Attorney, Agent, or Firm*—Wood, Phillips, Mason, Recktenwald & VanSanten

[57] ABSTRACT

An impingement plate type heat exchanger for exchanging heat between first and second fluids in different paths. A stack of plates include impingement orifice plates and heat exchange orifice plates defining first and second tortuous flow paths generally parallel to each other and generally perpendicularly through the plates for the first and second fluids, respectively. The heat exchange orifice plates span both flow paths, and there are more impingement orifice plates in one flow path than the other to provide a more tortuous flow path for one fluid than the other. Partition plates have relatively large openings surrounding arrays of orifices in the impingement orifice plates and the heat exchange orifice plates to define the boundaries of the flow paths.

9 Claims, 2 Drawing Sheets

IMPINGEMENT PLATE TYPE HEAT EXCHANGER

FIELD OF THE INVENTION

This invention generally relates to heat exchangers and, particularly, to a heat exchanger of the impingement plate type.

BACKGROUND OF THE INVENTION

Heat exchangers using an impingement cooling principal are known for exchanging heat between different fluids flowing through the exchanger. Some heat exchangers that use the impingement cooling principal are of the impingement plate type. With such heat exchangers, fluid passes through a plurality of holes in a given plate and strikes a solid portion or "impinges" against a subsequent, usually parallel, plate where it moves along the plate to the nearest orifice and passes through the subsequent plate for impinging against a solid portion of the next plate. Eventually, after passing through a series of plates, the fluid leaves the heat exchanger. This impingement cooling principal aids in the heat transfer between the fluid and each plate. Of course, the holes or orifices in adjacent plates are misaligned intentionally so that the fluid must impinge against a subsequent plate prior to passing through the orifices thereof. This forces the fluid to impinge against each plate after passing through the previous plate to provide a tortuous path for the fluid rather than permitting the fluid merely to flow through holes in a stack of plates.

Some examples of such plate type heat exchangers are shown in U.S. Pat. No. 4,494,171 to Bland et al, dated Jan. 15, 1985 and assigned to the assignee of this invention, as well as other U.S. Pat. No. 4,096,910 to Coffinberry et al, dated June 27, 1978; U.S. Pat. No. 4,347,897 to Sumitomo et al, dated Sept. 7, 1982; and U.S. Pat. No. 4,624,305 to Rojey, dated Nov. 5, 1986.

Most such plate type heat exchangers are designed to exchange heat between fluids which are generally similar. However, there is a need for a new and improved heat exchanger of the character described for accommodating fluids of different characteristics. For instance, it might be desirable to provide different flow paths for fluids of considerably different viscosities, or for one fluid which may be more "dirty" (i.e., containing more particulate matter) than the other. In addition, different fluids can withstand different pressure drops through a heat exchanger such as the impingement plate type. It may desirable to cool an oxidizer using hydrogen as the coolant, and a different pressure drop may be required through one flow path than the other. This invention is directed to a new and improved plate type heat exchanger providing different flow paths for fluids of different characteristics.

SUMMARY OF THE INVENTION

An object, therefore, of the invention is to provide a new and improved impingement plate type heat exchanger for exchanging heat between at least first and second fluids.

In the exemplary embodiment of the invention, the heat exchanger is in the form of a stack of plates including impingement orifice plates and at least one heat exchange orifice plate defining first and second tortuous flow paths generally parallel to each other and generally perpendicularly through the plates, for the first and second fluids respectively. At least one heat exchange orifice plate spans both flow paths. The invention contemplates providing more of the impingement orifice plates in one of the flow paths than in the other to provide a more tortuous flow path for one fluid than the other.

Partition means are provided between the plates to separate the first and second flow paths. As disclosed herein, the partition means is in the form of third plates having relatively large openings surrounding arrays of orifices in the orifice plates. The openings in the third plates define the boundaries of the flow paths.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
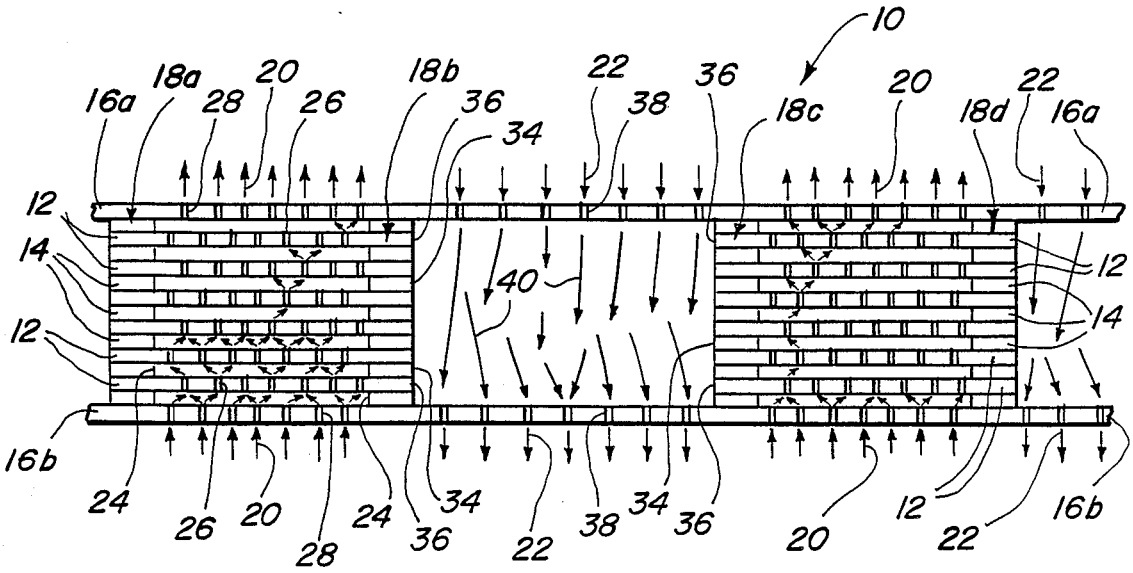
FIG. 1 is a fragmented section through an impingement plate type heat exchanger incorporating the concepts of the invention.

Referring to the drawings in greater detail, and first to FIG. 1, an impingement plate type heat exchanger, generally designated 10, is shown for exchanging heat between first and second fluids. Generally, the heat exchanger is formed by a stack of plates, there being three different types of plates making up the stacked configuration as shown in FIG. 1. As will be described and understood in greater detail hereinafter, a plurality of impingement orifice plates 12 alternate in a stack with a plurality of partition plates 14. This stack of plates is sandwiched between a pair of heat exchange orifice plates **16*a* and 16*b* at opposite ends of the stack. Of course, it immediately should be understood that FIG. 1 can be considerably expanded whereby an additional stack of orifice plates 12 and partition plates 14 can be placed above the top heat exchange orifice plate 16*a* or below the bottom heat exchange orifice plate 16*b*, and additional heat exchange orifice plates 16*a*, 16*b*** added to expand the through dimensions of the heat exchanger.

In essence, partition orifice plates 14 define the boundaries of the flow paths through the heat exchanger. More particularly, it can be seen that partition plates 14 and impingement orifice plates 12 alternate in an abutting relationship to define through walls, generally designated **18*a*, 18*b*, 18*c* and 18*d*. These walls themselves transfer heat between the flow paths. A first flow path for a first fluid is shown by arrows 20 representing the first fluid passing through the heat exchanger from the bottom to the top as viewed in FIG. 1. Arrows 22** represent a second flow path for a second fluid flowing through the heat exchanger in the opposite direction of the first flow path. It can be seen in FIG. 1 that there are a plurality (two) first flow paths 20 and second flow paths 22 going from left to right in the drawing. This simply represents that the two fluids may not simply flow through the heat exchanger in a single pass but may sinusoidally go back and forth through the heat exchanger for further cooling purposes.

Partition plates 14 have enlarged openings 24 which are aligned through the heat exchanger for surrounding arrays of orifices 26 in impingement orifice plates 12 and orifices 28 in heat exchange orifice plates 16*a*, 16*b*. In essence, these enlarged openings actually define first flow path 20 for the first fluid through the heat exchanger.

Figure 2:
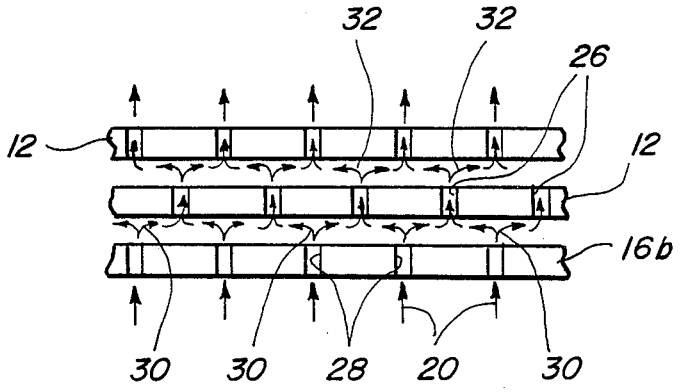
FIG. 2 is an enlarged fragmented section of the orifice plates in one of the flow paths of the heat exchanger of FIG. 2.

At this point, reference is made to FIG. 2 wherein a portion of heat exchange orifice plate 16*b* is shown in conjunction with portions of a pair of impingement orifice plates 12. It can be seen that the first fluid flows through orifices 28 in heat exchange orifice plate 16*b*, in the direction of arrows 20. After passing through orifices 28, the fluid impinges upon solid portions of the first impingement orifice plate, as represented by arrows 30. After the fluid strikes or "impinges" against the solid portions of the first impingement orifice plate 12, the fluid moves along the plate to the adjacent orifices 26 and passes through that plate for impingement upon the subsequent impingement orifice plate 12, as indicated by arrows 32. Once again, the impinging fluid moves along the subsequent plate and passes through the orifices therein and so on through the stack of plates. The orifices in adjacent heat exchange orifice plates 16*b* (or 16*a*) and the stacked impingement orifice plates 12 are misaligned intentionally so that the fluid must impinge against a subsequent plate prior to passing through the orifices in that plate, and so on through the heat exchanger. As can be seen in FIG. 1, this described structure and operation of flow path 20 provides a rather severe tortuous flow path.

Partition plates 14 also have enlarged openings 34 which are aligned with enlarged openings 36 in impingement orifice plates 12. Aligned enlarged openings 34 and 36 define the second flow path 22 through the heat exchanger, and effectively surround arrays of orifices 38 in heat exchange orifice plates 16*a*, 16*b*. However, it should be noted that flow path 22 is substantially unrestricted through at least the portion of the heat exchanger as shown in FIG. 1, as depicted by arrows 40. Obviously, this flow path is a much less tortuous flow path than the first flow path 20. The spacing of heat exchange orifice plates 16*a*, 16*b* and the number of impingement orifice plates 12 are shown in FIG. 1 to emphasize the invention. Obviously, there may be one or more heat exchange orifice plates between plates 16*a* and 16*b*, but less in number than impingement orifice plates 12, still providing a less tortuous flow path 22 than flow path 20.

Figure 3:
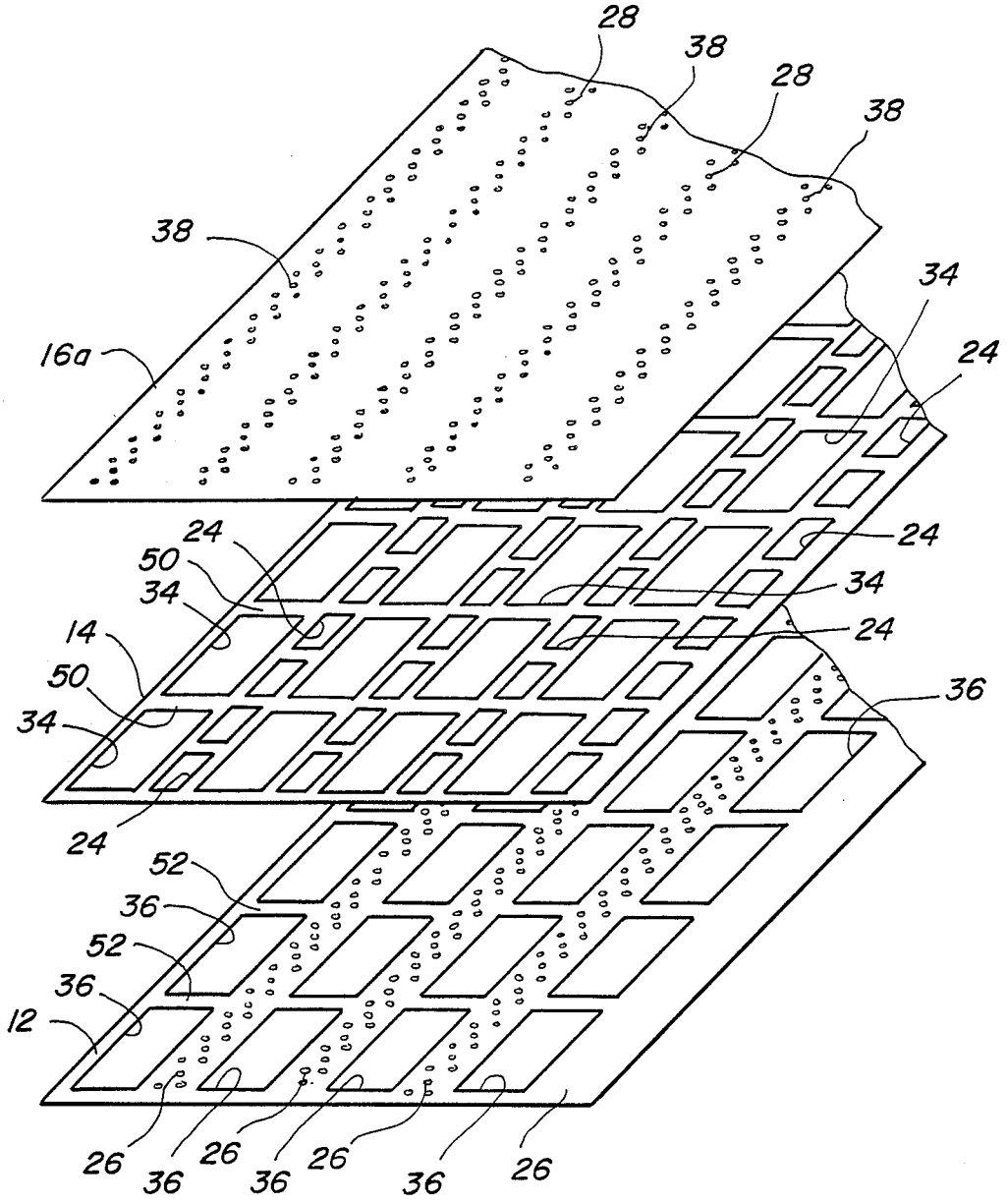
FIG. 3 is an enlarged, exploded perspective view of the three types of plates which make up the heat exchanger depicted in FIG. 1.

FIG. 3 shows an enlarged, exploded depiction of upper heat exchange orifice plate 16*a*, one of the impingement orifice plates 12, and one of the partition plates 14 disposed between plates 12 and 16*a*. This depiction shows how these three singular plates form all of the flow paths through the heat exchanger, how the lateral dimensions of the heat exchanger can be greatly expanded to provide multiple flow paths, either for repeated flow of two fluids back and forth through the heat exchanger or for the flow of a plurality of fluids therethrough. Regardless of the application, it can be seen that heat exchanger orifice plate 16 has the above-described orifices 38 arranged in elongated arrays in alignment with the above-described enlarged openings 34 in partition plate 14 and with the enlarged openings 36 in impingement orifice plate 12. If the drawing was expanded to the extent as shown in FIG. 1, it can be understood that there would be additional, alternating plates 14 and 12, with openings 34 and 36 all being aligned and aligned with orifices 38. This defines the flow path 22 described above, extending through the heat exchanger and providing less tortuous flow paths therethrough. Actually, an appropriate manifold would feed the second fluid to orifices 38 the full length of the arrays. Webs 50 in plate 14 and webs 52 in plate 12 simply are provided for strengthening purposes.

FIG. 3 also shows heat exchange orifice plate 16*a* to have elongated arrays of the above-described orifices 28. These orifices are aligned with enlarged openings 24 in partition plate 14 and arrays of orifices 26 in impingement orifice plate 12. Of course, there would be additional plates 12 and 14 alternating through the stack as described in relation to FIG. 1 and, consequently, creating the above-described greater tortuous path for first flow path 20.

Plates 12, 14, 16*a* and 16*b* all are generally planar, arranged in the stack in generally parallel relationship and, preferably, are joined, as by brazing, to provide a rigid structure whereby the different fluids pass through the plates and their respective flow paths, as the plates exchange temperatures between the fluids. FIG. 3 shows how the plates surround all of the orifices and the different enlarged openings in the plates which define the flow paths and by which excellent transfer of heat is effected from one fluid to the other. One's imagination can only achieve the different degrees of tortuous flow paths through the heat exchanger to accommodate different fluids having different characteristics. All three plates extend throughout the heat exchanger tranversely of the flow paths to effectively transfer heat and still provide different tortuous paths through the assembly.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed:

1. An impingement plate type heat exchanger for exchanging heat between first and second fluids, comprising a stack of plates including impingement orifice plates and at least one heat exchange orifice plate defining first and second tortuous flow paths generally parallel to each other and generally perpendicularly through the plates for the first and second fluids, respectively, the at least one heat exchange orifice plate spanning both flow paths, and there being more said impingement orifice plates in one said flow path than the other to provide a more tortuous flow path for one fluid than the other.

2. The impingement plate type heat exchanger of claim 1, including partition means between the plates to separate the first and second flow paths.

3. The impingement plate type heat exchanger of claim 2 wherein said partition means comprise third plates having relatively large openings surrounding arrays of orifices in said orifice plates.

4. The impingement plate type heat exchanger of claim 3 wherein said openings in said third plates define the boundaries of said flow paths.

5. An impingement plate type heat exchanger for exchanging heat between first and second fluids, comprising a stack of orifice plates defining first and second tortuous flow paths generally parallel to each other and generally perpendicularly through the plates for the first and second fluids, respectively, said orifice plates being arranged in number and orifice configuration to provide a more tortuous path through one of said flow paths than the other.

6. The impingement plate type heat exchanger of claim 5, including partition means between the plates to separate the first and second flow paths.

7. The impingement plate type heat exchanger of claim 6, wherein said partition means comprise partition plates having relatively large openings surrounding arrays of orifices in said orifice plates.

8. The impingement plate type heat exchanger of claim 7, wherein said openings in said partition plates define the boundaries of said flow paths.

9. An impingement plate type heat exchanger for exchanging heat between first and second fluids, comprising orifice plate means defining a first flow path for the first fluid and a second flow path for the second fluid, with heat exchange plate means extending between the flow paths, there being more orifice plates in one of the flow paths than the other to provide a more tortuous flow path for one said fluid than the other.

* * * * *